US009136628B2

(12) United States Patent
Aizawa et al.

(10) Patent No.: US 9,136,628 B2
(45) Date of Patent: Sep. 15, 2015

(54) CRIMP TYPE TERMINAL FITTING

(71) Applicants: AUTONETWORKS TECHNOLOGIES, LTD, Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Takeshi Aizawa, Yokkaichi (JP); Satoshi Morikawa, Yokkaichi (JP); Yoshihiro Uchiyama, Yokkaichi (JP); Kazuaki Takeda, Yokkaichi (JP); Takashi Tonosaki, Yokkaichi (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 14/364,517

(22) PCT Filed: Nov. 28, 2012

(86) PCT No.: PCT/JP2012/080681

§ 371 (c)(1),
(2) Date: Jun. 11, 2014

(87) PCT Pub. No.: WO2013/088952

PCT Pub. Date: Jun. 20, 2013

(65) Prior Publication Data

US 2014/0378011 A1 Dec. 25, 2014

(30) Foreign Application Priority Data

Dec. 12, 2011 (JP) ..... 2011-271012

(51) Int. Cl.
*H01R 13/02* (2006.01)
*H01R 4/18* (2006.01)

(Continued)

(52) U.S. Cl.
CPC ..... *H01R 13/02* (2013.01); *H01R 4/18* (2013.01); *H01R 4/185* (2013.01); *H01R 4/62* (2013.01); *H01R 13/03* (2013.01); *H01R 43/048* (2013.01)

(58) Field of Classification Search
CPC ..... H01R 4/18; H01R 4/182; H01R 4/48; H01R 4/58; H01R 43/048; H01R 13/02; H01R 13/03
USPC ..... 439/878, 519, 877; 29/87, 874
See application file for complete search history.

(56) References Cited

U.S. PATENT DOCUMENTS
2,783,447 A * 2/1957 Watts ..... 439/406
3,355,698 A * 11/1967 Keller ..... 439/421

(Continued)

FOREIGN PATENT DOCUMENTS
JP 50-127677 4/1949

(Continued)

OTHER PUBLICATIONS
Office Action in a Japanese Patent Appl. No. 2011-271012—Oct. 2, 2014.

(Continued)

*Primary Examiner* — Abdullah Riyami
*Assistant Examiner* — Peter G Leigh
(74) *Attorney, Agent, or Firm* — Gerald E. Hespos; Michael J. Porco; Matthew T. Hespos

(57) ABSTRACT

A terminal fitting (20) is crimped to an aluminum wire including a core (12) formed by putting a plurality of strands (11) together. The terminal fitting (20) includes a bottom plate (22) on which the core (12) is placed, and two barrel pieces (25L, 25R) connected to the bottom plate (22) and crimped to the core (12) so as to embrace the core (12) placed on the bottom plate (22). Overlapping portions (24L, 24R) are formed on tip parts of the respective barrel pieces (25L, 25R) by folding a plate material forming the barrel pieces (25L, 25R) to overlap layers of the plate material. The overlapping portions (24L, 24R) contact each other without intruding between the strands (11) when the respective barrel pieces (25L, 25R) are crimped to the core (12). The terminal fitting (20) eliminates breakage of the core (12) and is less affected by spring back.

8 Claims, 7 Drawing Sheets

(51) Int. Cl.

| | |
|---|---|
| *H01R 13/03* | (2006.01) |
| *H01R 43/048* | (2006.01) |
| *H01R 4/62* | (2006.01) |

(56) References Cited

U.S. PATENT DOCUMENTS

| | | | | | |
|---|---|---|---|---|---|
| 3,798,347 | A * | 3/1974 | Harding et al. | 174/84 C |
| 4,142,771 | A * | 3/1979 | Barnes et al. | 439/442 |
| 4,229,063 | A * | 10/1980 | Yoshizawa | 439/442 |
| 5,561,267 | A * | 10/1996 | Fudoo et al. | 174/84 C |
| 7,306,495 | B2 | 12/2007 | Hashimoto et al. | |
| 7,611,392 | B2 * | 11/2009 | Osborn et al. | 439/877 |
| 8,221,171 | B2 * | 7/2012 | Ono et al. | 439/877 |
| 2003/0060091 | A1 * | 3/2003 | Fukatsu | 439/884 |
| 2005/0026515 | A1 | 2/2005 | Hashimoto et al. | |
| 2010/0230160 | A1 * | 9/2010 | Ono et al. | 174/84 |
| 2010/0261391 | A1 * | 10/2010 | Ono et al. | 439/877 |

FOREIGN PATENT DOCUMENTS

| | | |
|---|---|---|
| JP | 55-120080 | 2/1954 |
| JP | 57-27668 | 3/1956 |
| JP | 51-38085 | 3/1976 |
| JP | S51-038687 | 3/1976 |
| JP | 08-315886 | 11/1996 |
| JP | 2009-123622 | 6/2009 |

OTHER PUBLICATIONS

International Search Report of Jan. 15, 2013.
Written Opinion of Dec. 27, 2012.

* cited by examiner

CRIMP TYPE TERMINAL FITTING

TECHNICAL FIELD

The present invention relates to a terminal fitting to be crimped to a wire including a core formed by putting a plurality of strands together.

BACKGROUND ART

In recent years, aluminum wires have been used for the purpose of weight reduction and the like also in the field of automotive wiring harnesses and the like. An aluminum wire is, for example, structured such that a core formed by twisting a plurality of aluminum strands is covered by an insulation coating, and a terminal fitting is generally connected to an end of the wire when the wire is assembled into a wiring harness. Specifically, an end of the coating of the aluminum wire is removed to expose an end of the core, a wire barrel (wire connecting portion) provided on the terminal fitting is crimped to the exposed end of the core, and an insulation barrel provided behind the wire barrel is crimped and connected to an end of the remaining insulation coating (see, for example, Japanese Unexamined Patent Publication No. 2005-50736). Such a terminal fitting is formed by press-working a metal plate with good electrical conductivity.

However, since the tips of the wire barrel are pushed into between the twisted strands, the core may be broken if the wire barrel is crimped under high compression. Further, in the case of spring back (phenomenon in which each wire barrel is going to be open upward), a ceiling plate portion most subject to a force has a thickness equal to one metal plate described above and, hence, is easily affected by spring back. Particularly, in the case of using an aluminum wire, if spring back occurs in the wire barrel and a stress is alleviated, the core is unlikely to follow the wire barrel, thereby forming a clearance between the core and the wire barrel. Therefore, it may not be possible to obtain desired contact resistance and crimping strength.

The present invention was completed based on the above situation and an object thereof is to eliminate the breakage of a core and reduce the influence of spring back.

SUMMARY OF THE INVENTION

The present invention is directed to a terminal fitting to be crimped to a wire including a core formed by putting a plurality of strands together, including a bottom plate portion on which the core is to be placed; and a pair of crimping pieces connected to the bottom plate portion and to be crimped to the core in such a manner as to embrace the core placed on the bottom plate portion; wherein overlapping portions are formed on tip parts of the respective crimping pieces by folding a plate material forming the crimping pieces to overlap layers of the plate material, and the respective overlapping portions come into contact with each other without intruding into between the strands when the respective crimping pieces are crimped to the core.

According to such a configuration, the tip parts of the crimping pieces are thicker than when the overlapping portions are not formed since the overlapping portions are formed on the tip parts of the crimping pieces. Thus, in compressing the core at a predetermined compression rate, the crimping pieces are more difficult to deform than when the overlapping portions are not formed. This can maintain contact resistance and crimping strength in an initial stage of a crimping operation by suppressing spring back of the crimping pieces. Further, since the respective overlapping portions come into contact with each other without intruding into between the strands, the terminal fitting can be crimped and connected without causing the breakage of the core.

The following configurations are preferable as embodiments of the invention.

A one-side abutting surface to be brought into surface contact with the other overlapping portion may be formed on a folded part of one overlapping portion. According to such a configuration, the influence of spring back can be reduced more since the opening of the respective crimping pieces can be restricted by bringing the one-side abutting surface and the other overlapping portion into surface contact.

An other-side abutting surface to be brought into surface contact with the one-side abutting surface may be formed on a folded part of the other overlapping portion. Further, the one-side and other-side abutting surfaces may be held in close contact with each other. According to such a configuration, the influence of spring back can be reduced even more since the opening of the respective crimping pieces can be restricted by bringing the one-side abutting surface and the other-side abutting surface into surface contact.

The layers of the plate material forming the overlapping portion may be held in close contact with each other. According to such a configuration, the breakage of the core can be prevented since there is no room between the layers of the plate material forming the overlapping portion into which the strands intrude.

The plate material may be folded toward the core side in the overlapping portion. According to such a configuration, contact resistance can be reduced more since the overlapping portions can be held in close contact with the core.

Each overlapping portion may include an inner contact surface extending in a circumferential direction of the core and to be brought into contact with the outermost surface of the core, and a contacted surface to be brought into contact with the inner contact surface out of the outermost surface of the core may be arranged flush with or outward of an adjacent surface connected to the contacted surface in a crimping direction of each crimping piece. According to such a configuration, the respective overlapping portions do not intrude into between the respective cores since the contacted surface of the core is arranged flush with or outward of the adjacent surface of the core in the crimping direction of each crimping piece.

A rounded arcuate surface may be formed by striking on a side of a tip part of each crimping piece to be brought into contact with the plate material, and the overlapping portion may be formed by bringing the plate material into close contact with the arcuate surface. According to such a configuration, the tip part of each crimping piece does not intrude into between the respective cores since the overlapping portion is formed by holding the plate material in close contact with the arcuate surface formed on the tip part of each crimping piece.

The overlapping portion may be formed by folding the plate material toward a side opposite to the core. According to such a configuration, the breakage of the core can be further eliminated since there is no room between the strands into which the overlapping portions intrude.

According to the present invention, it is possible to eliminate the breakage of a core and reduce the influence of spring back.

DETAILED DESCRIPTION OF THE PREFERRED EMBODIMENTS

Figure 1:
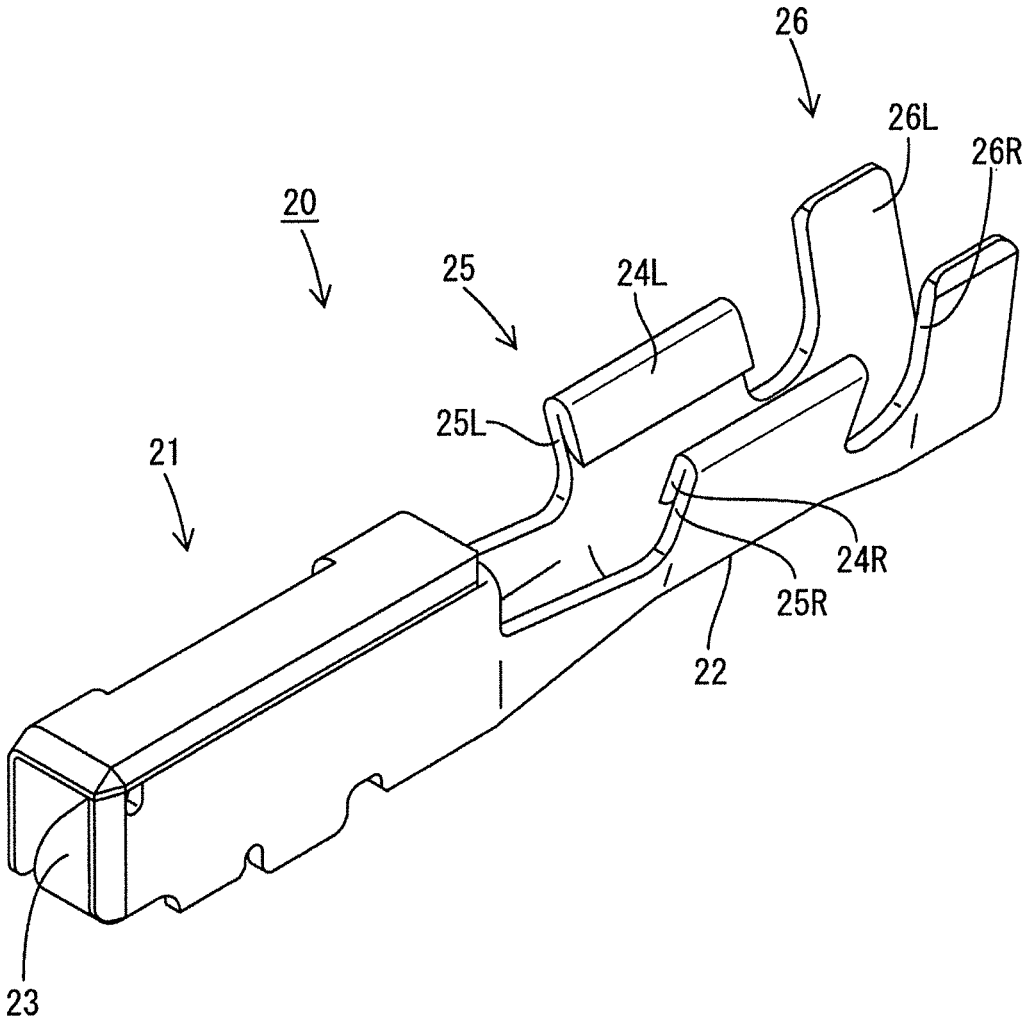
FIG. 1 is a perspective view showing a terminal fitting in a first embodiment.

A first embodiment of the present invention is described with reference to FIGS. 1 to 6. As shown in FIG. 1, a female terminal fitting 20 to be connected to an end of an aluminum wire (not shown) is illustrated in this embodiment. The aluminum wire is structured such that a core 12 is formed by twisting a plurality of strands 11 made of aluminum or aluminum alloy and covered by an insulation coating (not shown) made of synthetic resin.

The female terminal fitting 20 is formed by press-working a metal plate with good electrical conductivity made of copper alloy or the like, and structured such that a wire barrel 25 and an insulation barrel 26 are provided behind a terminal connecting portion 21 substantially in the form of a rectangular tube to be electrically connected to a mating male terminal fitting (not shown).

A resilient contact piece 23 folded back at the front edge of a bottom plate portion 22 is provided in the terminal connecting portion 21. A tab of the above mating male terminal fitting is inserted into this terminal connecting portion 21 from front and resiliently comes into contact with the resilient contact piece 23, whereby the male terminal fitting and the female terminal fitting 20 are electrically connected.

Figure 6:
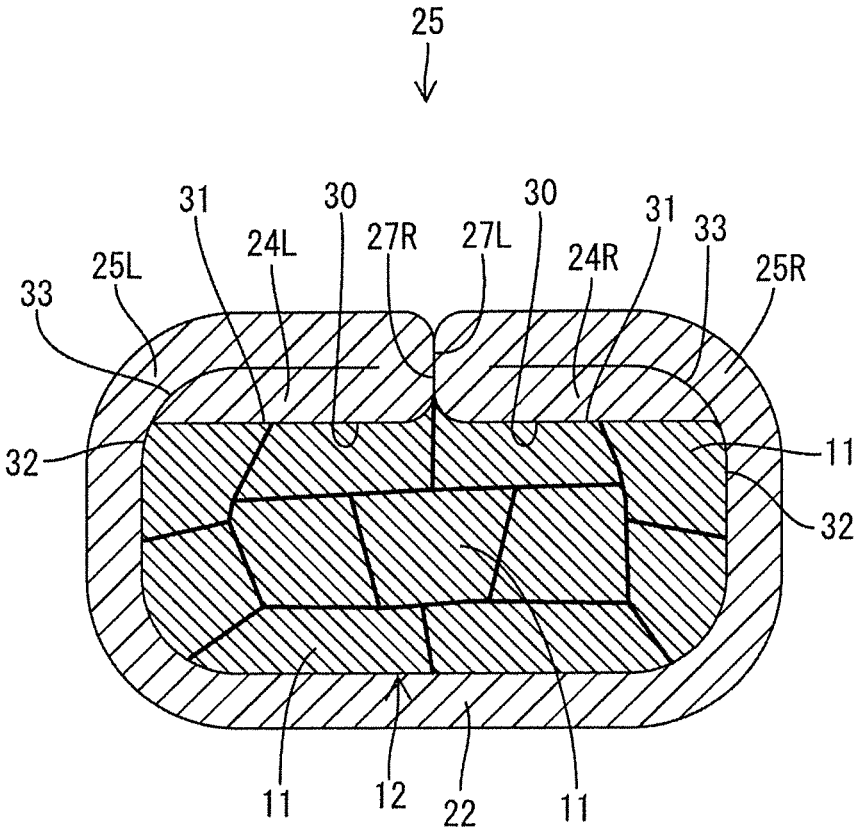
FIG. 6 is a section showing a state where the wire barrel is crimped to a core in a state of FIG. 5.

The wire barrel 25 is of an open barrel type and connected to the bottom plate portion 22 such that a pair of left and right wide barrel pieces 25L, 25R rise from left and right edges of the bottom plate portion 22 while facing each other. The wire barrel 25 is caulked and crimped to an end of a core 12 of the aluminum wire by vertically crimping the respective barrel pieces 25L, 25R. For example, the wire barrel 25 is so flattened and crimped to the core 12 as to surround the entire circumference of the end of the core 12 while folded parts of the both barrel pieces 25L, 25R butt against each other as shown in FIG. 6.

The insulation barrel 26 is likewise of an open barrel type and connected to the bottom plate portion 22 such that a pair of left and right barrel pieces 26L, 26R narrower and taller than the barrel pieces 25L, 25R of the wire barrel 25 rise from the left and right edges of the bottom plate portion 22 while facing each other. The insulation barrel 26 is caulked and crimped to an end of an insulation coating of the aluminum wire by vertically crimping the respective barrel pieces 26L, 26R. For example, the insulation barrel 26 is caulked in a so-called overlapping manner such that the both barrel pieces 26L, 26R embrace the outer periphery of the end of the insulation coating from opposite left and right sides while overlapping projecting ends thereof.

Overlapping portions 24L, 24R are formed on tip parts of the respective barrel pieces 25L, 25R of the wire barrel 25. These overlapping portions 24L, 24R are formed by folding the metal plate forming the barrel pieces 25L, 25R such that folded sides are held in close contact, i.e. a plurality of layers of the metal plate overlap. The overlapping portions 24L, 24R of this embodiment are formed by two overlapping layers of the metal plate. Further, the overlapping portions 24L, 24R of this embodiment are formed by folding the metal plate toward the side of the core 12.

Upper and lower layers of the metal plate forming each overlapping portion 24L, 24R are held in close contact with each other. Joint surfaces of the respective layers of the metal plate are arranged to be perpendicular to an axis vertically passing through an axial center of the core 12. Each overlapping portion 24L, 24R includes an inner contact surface 30 extending in a circumference direction of the core 12 and to be brought into contact with the outermost surface of the core 12. On the other hand, the outermost surface of the core 12 is composed of a contacted surface 31 to be held in contact with the inner contact surfaces 30 and an adjacent surface 32 adjacent to this contacted surface 31. The contacted surface 31 is arranged to be higher than the adjacent surface 32. This causes the overlapping portions 24L, 24R to be held in contact with each other and in close contact with the core 12 without intruding into between the respective strands 11 when a crimping operation is performed.

Further, a rounded arcuate surface 33 is formed by striking an upper corner part on a tip part of the lower layer of the metal plate of each barrel piece 25L, 25R. This arcuate surface 33 is held in close contact with the lower surface of the upper layer of the metal plate of the corresponding barrel piece 25L, 25R. Thus, the tip part of each barrel piece 25L, 25R does not intrude into between the respective strands 11 when the crimping operation is performed.

The folded part of the left overlapping portion 24L is formed with a flat one-side abutting surface 27L, and that of the right overlapping portion 24R is formed with a flat other-side abutting surface 27R. The respective abutting surfaces 27L, 27R are brought into close contact with each other and made flat by strongly pressing the folded parts of the respective overlapping portions 24L, 24R from opposite left and right sides during the crimping operation. The respective abutting surfaces 27L, 27R are arranged along the axis vertically passing through the axial center of the core 12. Further, the respective abutting surfaces 27L, 27R are held in surface contact with each other and a vertical dimension of the contact surfaces is substantially equal to a thickness of one metal plate.

Since having a thickness equal to twice the thickness of the metal plate, the respective overlapping portions 24L, 24R have a high rigidity and are difficult to deform. This can prevent spring back of the wire barrel 25. Further, if spring back is about to occur in the wire barrel 25, the respective abutting surfaces 27L, 27R come into surface contact with each other, thereby restricting upward opening of the respective barrel pieces 25L, 25R. This can also prevent spring back of the wire barrel 25. As a result, no clearances are formed between the respective barrel pieces 25L, 25R and the core 12 and contact resistance and crimping strength in an initial stage of the crimping operation can be maintained.

Figure 2:
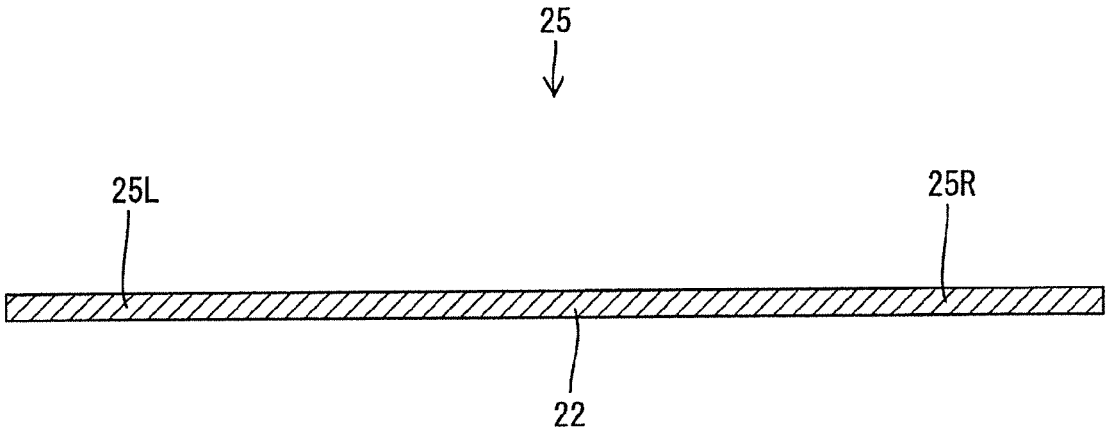
FIG. 2 is a section showing a part corresponding to a wire barrel out of a metal material as a base material of the terminal fitting.
Figure 3:
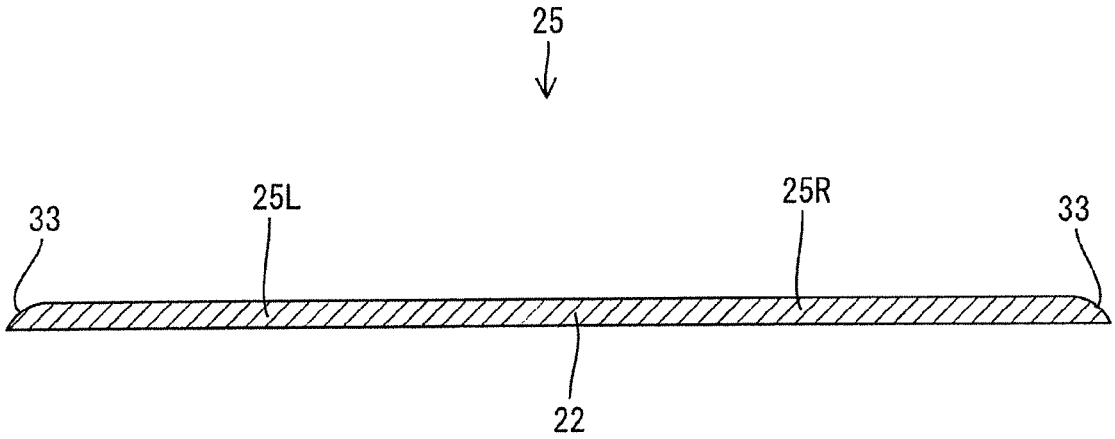
FIG. 3 is a section showing a state where rounded contact curved surfaces are formed by striking upper corner parts of tip parts of respective barrel pieces in a state of FIG. 2.

Next, a manufacturing process and a crimping process of the wire barrel 25 of the female terminal fitting 20 are briefly described with reference to FIGS. 2 to 6. FIG. 2 is a section showing the wire barrel 25 in a development state, and the metal plate as a base material of the female terminal fitting 20 is punched out into a predetermined shape. FIG. 3 is a section showing a state where the arcuate surfaces 33 are formed by striking the upper corner parts of the tips of the respective barrel pieces 25L, 25R.

Figure 4:
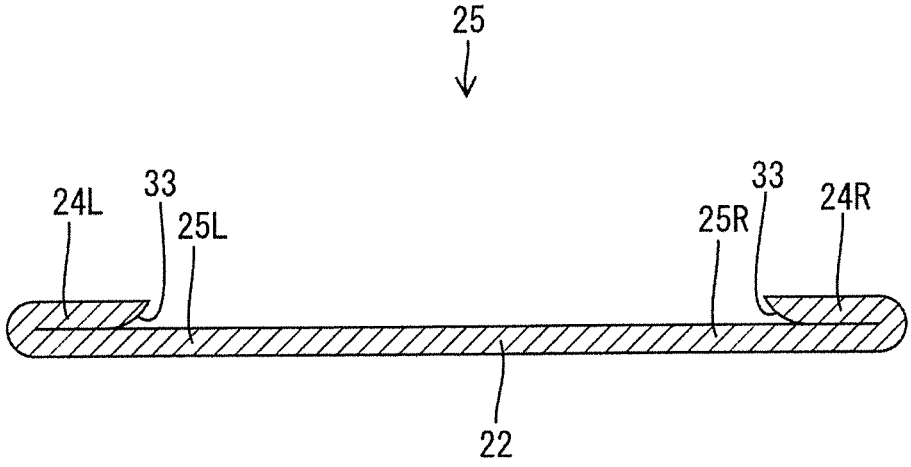
FIG. 4 is a section showing a state where overlapping portions are formed by folding the tip parts of the respective barrel pieces in a state of FIG. 3.
Figure 5:
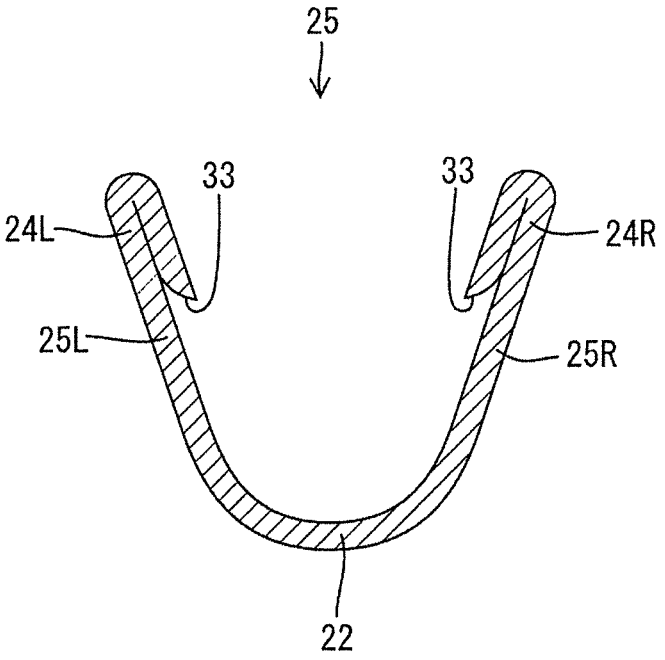
FIG. 5 is a section showing a state where the wire barrel is formed by bending the respective barrel pieces into a substantially U shape in a state of FIG. 4.

Subsequently, as shown in FIG. 4, the tip parts of the respective barrel pieces 25L, 25R are folded to form the respective overlapping portions 24L, 24R. Subsequently, as shown in FIG. 5, the bottom plate portion 22 is bent into a substantially U shape so that the respective barrel pieces 25L, 25R rise while facing each other. As a result, the wire barrel 25 shown in FIG. 1 is formed and the female terminal fitting 20 is completed.

Thereafter, the core 12 is placed on the bottom plate portion 22 of the wire barrel 25 and the respective barrel pieces 25L, 25R are caulked and crimped to embrace the core 12. At this time, the overlapping portions 24L, 24R of the respective barrel pieces 25L, 25R do not intrude into between the respective strands 11 and do not cause the breakage of the core 12.

More specifically, at the same time as the folded parts of the respective overlapping portions 24L, 24R are pressed against each other from opposite left and right sides to form the respective abutting surfaces 27L, 27R, the respective overlapping portions 24L, 24R are pushed also from opposite upper and lower sides. Thus, the respective abutting surfaces 27L, 27R come into close surface contact with the each other and the respective overlapping portions 24L, 24R come into close contact with the core 12. Simultaneously, the upper and lower layers of the metal plate forming the respective overlapping portions 24L, 24R also come into close contact with each other and the lower surfaces of the upper layers of the metal plate come into contact with the respective arcuate surfaces 33, 33. As a result, the inner contact surfaces 30, 30 of the respective overlapping portions 24L, 24R are formed into flat surfaces. Since the core 12 is caulked below the respective inner contact surfaces 30, 30, the respective overlapping portions 24L, 24R do not intrude into the core 12.

Here, if a force acts on the wire barrel 25 in an opening direction to cause spring back, the force in the opening direction can be withstood since the respective overlapping portions 24L, 24R are difficult to deform. Further, since being held in surface contact with each other, the abutting surfaces 27L, 27R of the respective overlapping portions 24L, 24R are caused to more strongly butt against each other to hold on by the force in the opening force. Thus, the opening of the respective barrel pieces 25L, 25R is restricted and spring back does not actually occur.

As described above, since the overlapping portions 24L, 24R are formed on the tip parts of the respective barrel pieces 25L, 25R to prevent the deformation of the barrel pieces 25L, 25R in this embodiment, it is possible to eliminate the breakage of the core 12 and prevent spring back. Further, since the respective abutting surfaces 27L, 27R come into surface contact, spring back can be efficiently prevented. Further, since the respective overlapping portions 24L, 24R are formed by folding the plate material toward the side of the core 12, the respective overlapping portions 24L, 24R and the core 12 can be held in close contact with each other.

Figure 7:
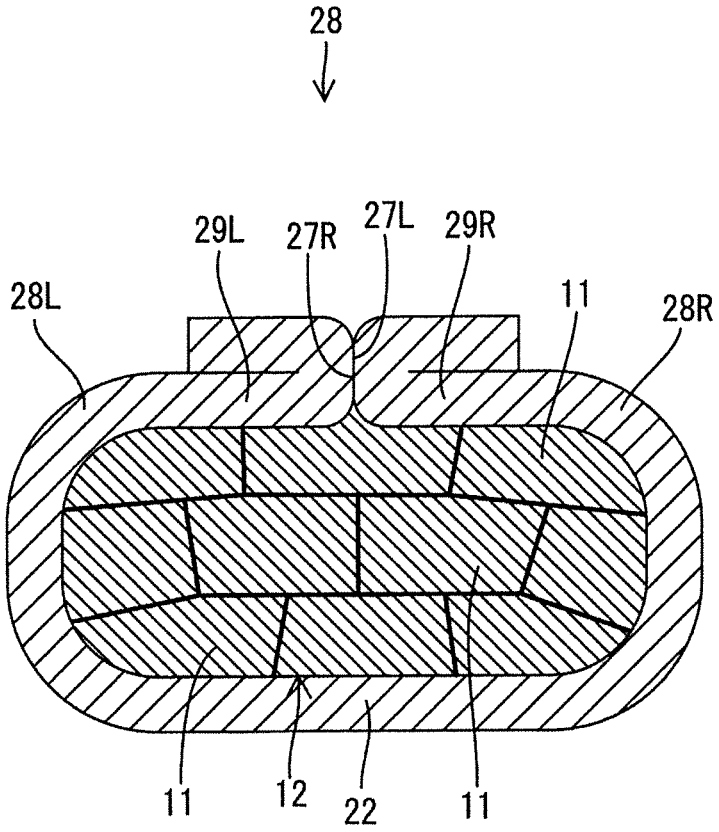
FIG. 7 is a section showing a state where a wire barrel is crimped to a core in a second embodiment.

Next, a second embodiment of the present invention is described with reference to FIG. 7. In a female terminal fitting of this embodiment, the configuration of the wire barrel 25 of the first embodiment is changed. The other configuration is not described since being the same as in the first embodiment. Specifically, a wire barrel 28 of this embodiment includes overlapping portions 29L, 29R formed on tip parts of barrel pieces 28L, 28R by folding a metal plate toward a side (upper side) opposite to a core 12. Further, a pair of upper and lower corner portions are left on the tip part of each barrel piece 28L, 28R and the arcuate surface 33 of the first embodiment is not formed. According to the respective overlapping portions 29L, 29R, there is no room between strands 11 into which the respective barrel pieces 28L, 28R intrude and the breakage of the core 12 can be reliably prevented.

The present invention is not limited to the above described and illustrated embodiments. For example, the following embodiments are also included in the technical scope of the present invention.

Although the abutting surfaces of the respective overlapping portions come into surface contact with each other in the above embodiments, they may come into line contact with each other according to the present invention.

Although the one-side abutting surface 27L comes into surface contact with the other-side abutting surface 27R in the above embodiments, the one-side abutting surface 27L has only to be in contact with the other overlapping portion at any position and the contact position does not matter.

Although the overlapping portion is formed by overlapping two layers of the metal plate in the above embodiments, it may be formed by overlapping three or more layers of the metal plate according to the present invention.

Although the aluminum wire is illustrated in the above embodiment, the present invention may be applied to a copper wire including a core made of copper alloy or the like. Further, although the female terminal fitting is illustrated in the above embodiments, the present invention may be applied to a male terminal fitting including a tab. Further, although the twisted strands are illustrated in the above embodiments, the present invention may be applied to a straight core in which strands are not twisted.

LIST OF REFERENCE SIGNS

11 . . . strand
12 . . . core
20 . . . female terminal fitting
22 . . . bottom plate portion
24L, 24R . . . overlapping portion
25 . . . wire barrel
25L, 25R . . . barrel piece (crimping piece)
27L . . . one-side abutting surface
27R . . . other-side abutting surface
28 . . . wire barrel
28L, 28R . . . barrel piece (crimping piece)
29L, 29R . . . overlapping portion
30 . . . inner contact surface
31 . . . contacted surface
32 . . . adjacent surface

The invention claimed is:

1. A terminal fitting to be crimped to a wire including a core having an outermost surface, the core being formed by putting a plurality of strands together, comprising:

a bottom plate portion on which the core is to be placed; and first and second crimping pieces connected to the bottom plate portion and to be crimped to the core in such a manner as to embrace the outermost surface of the core placed on the bottom plate portion;

wherein overlapping portions are formed on tip parts of the respective crimping pieces by folding a plate material forming each of the crimping pieces to overlap layers of the plate material, each of the crimping pieces includes an adjacent surface between the bottom plate and the overlapping portion of the respective crimping piece, each of the overlapping portions including an inner contact surface extending along the outermost surface of the core and contacting the outermost surface of the core, the inner contact surface including a flat portion between a fold defined in the respective crimping piece when forming the overlapping portion of the corresponding crimping piece and the adjacent surface of the corresponding crimping piece, the flat portion being farther out from the bottom plate portion than the adjacent surface in a crimping direction in which the crimping pieces are crimped and the respective overlapping portions come into contact with each other without intruding into between the strands when the respective crimping pieces are crimped to the core.

2. The terminal fitting of claim 1, wherein at least the first crimping pieces has an abutting surface at the fold, the abutting surface being brought into surface contact with the overlapping portion of the second crimping piece when the crimping pieces are crimped to the core.

3. The terminal fitting of claim 2, wherein each of the crimping pieces has one of the abutting surfaces at the fold in the respective crimping piece, the abutting surfaces being in surface contact with one another when the crimping pieces are crimped to the core.

4. The terminal fitting of claim 3, wherein the abutting surfaces of the crimping pieces are held in close contact with each other.

5. The terminal fitting of claim 1, wherein the layers of the plate material forming each of the overlapping portions are held in close contact with each other.

6. The terminal fitting of claim 1, wherein the plate material is folded toward the core in each of the overlapping portions.

7. The terminal fitting of claim 1, wherein a rounded arcuate surface is formed by striking on a side of a tip part of each crimping piece to be brought into contact with the plate material, and each of the overlapping portions is formed by bringing the plate material into close contact with the arcuate surface.

8. The terminal fitting of claim 1, wherein each of the overlapping portions is formed by folding the plate material toward a side opposite to the core.

* * * * *